US007234709B2

(12) United States Patent
Lambert

(10) Patent No.: US 7,234,709 B2
(45) Date of Patent: Jun. 26, 2007

(54) SKATING BLADE WITH IMPROVED ROCKER

(75) Inventor: Antoine Lambert, St-Jean-Chrysostome (CA)

(73) Assignee: Les Enterprises Aiguiso-Pro Inc., Québec (Québec) (CA)

( * ) Notice: Subject to any disclaimer, the term of this patent is extended or adjusted under 35 U.S.C. 154(b) by 147 days.

(21) Appl. No.: 10/303,795

(22) Filed: Nov. 26, 2002

(65) Prior Publication Data

US 2004/0100042 A1 May 27, 2004

(51) Int. Cl.
*A63C 1/32* (2006.01)

(52) U.S. Cl. ..... 280/11.18; 280/11.12

(58) Field of Classification Search ..... 280/11.12, 280/11.18, 842, 7.13, 841, 600, 609, 809, 280/11.17, 28
See application file for complete search history.

(56) References Cited

U.S. PATENT DOCUMENTS

| | | | | | |
|---|---|---|---|---|---|
| 94,336 | A | * | 8/1869 | Peer | 280/11.18 |
| 187,697 | A | | 2/1877 | Addir | |
| 235,492 | A | * | 12/1880 | Barney | 280/11.12 |
| 524,129 | A | | 8/1894 | Bryant | |
| 539,641 | A | * | 5/1895 | Parkhurst | 280/11.12 |
| 601,013 | A | * | 3/1898 | Evans | 280/11.12 |
| 1,181,831 | A | * | 5/1916 | Browne | 280/11.18 |
| 1,749,298 | A | | 3/1930 | Orafsik | |
| 1,826,958 | A | | 10/1931 | Sayer | |
| 2,108,128 | A | * | 2/1938 | Kinney | 280/11.18 |
| 2,150,964 | A | | 3/1939 | Dornseif | |
| 2,988,369 | A | | 6/1961 | Rebicek | |
| 3,026,119 | A | | 3/1962 | Bauer | |
| 3,036,840 | A | * | 5/1962 | Norgiel | 280/11.18 |
| 3,074,733 | A | * | 1/1963 | Norgiel | 280/11.18 |
| 3,558,149 | A | * | 1/1971 | Weidenbacker | 280/11.12 |
| 3,947,050 | A | * | 3/1976 | Isely | 280/11.18 |
| 4,131,288 | A | * | 12/1978 | Wilson | 280/11.17 |
| 4,314,708 | A | | 2/1982 | Zuuring | |
| 4,392,658 | A | | 7/1983 | Redmond et al. | |
| 5,354,078 | A | * | 10/1994 | BelleIsle | 280/11.18 |
| 5,570,893 | A | | 11/1996 | Swande | |
| 5,743,564 | A | * | 4/1998 | Aarnio et al. | 280/811 |
| 5,769,434 | A | * | 6/1998 | Wurthner | 280/11.18 |
| 5,813,678 | A | * | 9/1998 | Robins | 280/11.204 |
| 5,826,890 | A | | 10/1998 | Swande | |
| 5,988,683 | A | * | 11/1999 | Venier et al. | 280/841 |
| 6,568,710 | B2 | * | 5/2003 | Kim | 280/809 |
| 6,851,680 | B2 | * | 2/2005 | Pham et al. | 280/11.18 |
| 2001/0052678 | A1 | | 12/2001 | Titzmann | |

FOREIGN PATENT DOCUMENTS

| | | |
|---|---|---|
| CA | 1125804 | 6/1982 |
| CA | 2256921 | 6/2000 |
| CA | 2311951 | 12/2001 |
| GB | 2191100 A | 12/1987 |

* cited by examiner

*Primary Examiner*—Christopher P. Ellis
*Assistant Examiner*—Bridget Avery
(74) *Attorney, Agent, or Firm*—Ogilvy Renault, LLP

(57) ABSTRACT

A skating blade with a cross-section of three different portions. The upper portion is narrower, the middle portion is wider and the lower portion is trapezoidal to give improved ice penetration at the lower edges. The rocker is formed with two different curves. The front curve is defined by an arc of a circle and the rear curve is obtained by pivoting a radius forwardly along an arc of a circle and rearwardly along the rocker.

11 Claims, 2 Drawing Sheets

SKATING BLADE WITH IMPROVED ROCKER

BACKGROUND OF THE INVENTION

1. Field of the Invention

The present invention relates to an improved skating blade. More particularly, the invention is concerned with a skating blade of increased rigidity thereby increasing its performance. The skating blade according to the invention also permits better ice penetration, with the resulting advantages. According to a preferred embodiment, the skating blade according to the invention has a rocker that is shaped in a way to provide more comfort and security to the skater.

2. Description of the Prior Art

Skating blades that are presently available have many disadvantages. These may be summarized as lack of rigidity or stiffness of the blade and insufficient ice penetration of the edges of the blade when a person is skating.

Normally, a skating blade is 3 mm wide and this has become a standard requirement by manufacturer of supports that are used to fix the blade. So, some kind of compromise is desirable in order to meet manufacturers standards.

On the other hand, presently available blades have the same width throughout, and their rockers are curved with different shapes depending on the choice of the manufacturer which is dictated by its own research. With 3 mm blades, it is not easy to provide edges with less than 90° for better ice penetration. Furthermore, sharpening of the blades is normally carried out by following the curve outlines provided by the manufacturer, even if the latter is not completely desirable, with all the resulting disadvantages. More specifically, if it is decided to provide edges with less than 90°, the blade must be wider than 3 mm, which is not acceptable for fitting the blade into the support.

Ice penetration is very important when the skater is inclined or changes direction. In such a case, the skater feels that his skates lack a feeling of release. It is therefore desirable to provide skates with edges wherein the angle is less than 90°.

The curve that is given to the rocker by a manufacturer is often a source of discomfort, lack of speed and even leads to risk of injuries, not to mention the ease with which an abrupt turn can be achieved.

The prior art makes suggestions to improve the skating blade, however it is not believed that the above disadvantages may be overcome by the teaching of the following references:

Published U.S. application.:
2001/0052678

U.S. patents:
U.S. Pat. No. 5,826,890
U.S. Pat. No. 5,570,893
U.S. Pat. No. 4,392,658
U.S. Pat. No. 4,314,708
U.S. Pat. No. 3,026,119
U.S. Pat. No. 2,988,369
U.S. Pat. No. 2,150,964
U.S. Pat. No. 1,826,958
U.S. Pat. No. 1,749,298
U.S. Pat. No. 524,129
U.S. Pat. No. 187,697

Published British Application:
2 191 100A.

There is therefore a need to provide a skating blade that is generally free of the above disadvantages and finds satisfaction with most people using it.

It is therefore an object of the present invention to provide a skating blade that overcomes most of the above disadvantages.

It is another object of the present invention to provide a skating blade that gives improved ice penetration while affording comfort to the skater.

It is another object of the present invention to modify the shape of a skating blade in a manner that will provide skating edges with better ice penetration.

It is another object of the present invention to design the rocker of a skating blade with curves that will achieve comfort, better speed and less risk of injuries especially when turning abruptly, or in other skating phases.

SUMMARY OF THE INVENTION

These and other objects of the invention may be achieved by providing a skating blade having an upper portion, a middle portion and a lower portion, the upper portion having a width enabling to fix the skating blade to the support attached to a boot, the medium portion being wider than the upper portion, the lower portion having a generally trapezoidal cross-section, in which the uppermost part is narrower than the middle portion and a lowermost part is wider than the uppermost part so that the outer faces of the lower portion each define an angle with respect to a vertical plane extending through the lower edge of the skating blade.

The angle at the edges is preferably set at a value between 2 and 8°, most preferably between 4 and 5°.

In accordance with a preferred embodiment, the uppermost part of the lower portion is inwardly offset by about between 0.3 and 0.8 mm, preferably about 0.5 mm with respect to the middle portion.

In accordance with a preferred embodiment, the skating blade has a rocker that is shaped as a first arc of a circle whose center is substantially opposite a point between the front and rear of the skating blade, the first arc of a circle extending from that point to the front of the skating blade, the rocker having a back portion shaped according to a curve obtained by pivoting a radius of same length as the one used to obtain the first arc of a circle, forwardly from the above mentioned center along a second arc of a circle whose center corresponds to the above point, and rearwardly along the back portion of the rocker from that point to the rear of the skating blade.

Preferably, that point corresponds to the middle part of the rocker, and both the above mentioned radii have a length between 2 and 4 meters.

The invention also relates to a skating blade having a rocker shaped as a first arc of a circle whose center is substantially opposite a point between the front and rear of the skating blade, the first arc of a circle extending from that point to the front of the skating blade, the rocker having a back portion shaped according to a curve obtained by pivoting a radius of same length as the one used to obtain the first arc of a circle, forwardly from the above center along a second arc of a circle whose center corresponds to the above point, and rearwardly along the back portion of the rocker from that point to the rear of the skating blade.

The invention also relates to a method for shaping the rocker of a skating blade, which comprises shaping a forward curve by forming a first arc of a circle whose center is substantially opposite a point of the rocker between the front and rear of the skating blade, the first arc of a circle extending from that point to the front of the skating blade, and shaping a rearward curve by pivoting a radius of same length as the one used to obtain said first arc of a circle, forwardly from said center along a second arc of a circle whose center corresponds to said point, and rearwardly along the back portion of the rocker from that point to the rear of the skating blade.

For example, shaping may be achieved by providing and operating a shaping tool, followind by sliding a rocker of the skating blade against the shaping tool by providing the rocker with a forward curve and a rearward curve. It has been found that the Custom radius system of Blade Master is well suited for this shaping operation.

Another aspect of the invention provides an ice skate blade adapted for being mounted in a support attached to an ice skate boot The blade comprises: a lower portion defining a generally trapezoidal cross-section having a length 11, along a longitudinal axis, the trapezoidal cross-section having an uppermost part with a width w1, along a transversal axis perpendicular to the longitudinal axis, and a lowermost part with a width w2, along the transversal axis, wider than the width w1 of the uppermost part providing a pair of spaced-apart acute ice skating edges; a middle portion extending above the lower portion and having a cross-section defined with two longitudinal spaced-apart edges substantially parallel to one another, the cross-section of the middle portion having a width w3, along the transversal axis, and a length 12, along the longitudinal axis, the length 11 of the lower portion being longer than the length 12 of the middle portion and the width w3 being wider than the width w1 for reinforcing the blade; and an upper portion extending above the middle portion and having a cross-section with a width w4, along the transversal axis, narrower than the width w3 of the middle portion, the width w4 enabling to fix the skate blade to the support attached to the boot.

A further aspect of the invention provides an ice skate blade adapted for being mounted to an ice skate boot. The blade comprises a single, continuous ice contacting portion having a pair of parallel edges, the ice contacting portion having a front portion with a front curve and a rear portion with a rear curve different from the front curve along the length of the ice contacting portion, the front and the rear portions meeting at a junction point, the front curve defined by a first arc of a circle with a center and a radius, the center of the front curve being located along a line perpendicular to a tangent to the junction point at a distance from the junction point corresponding to the radius of the front curve, the rear curve of the rear portion having a contour obtained by pivoting the radius of the front curve forwardly from the center of the front curve along a second arc of a circle whose center corresponds to the junction point and rearwardly from the junction point along the rear portion of the ice contacting portion.

BRIEF DESCRIPTION OF DRAWINGS

The invention will now be illustrated by means of a preferred embodiment, given by way of illustration and without limitation, and in which.

DESCRIPTION OF PREFERRED EMBODIMENT

Figures 1, 2:
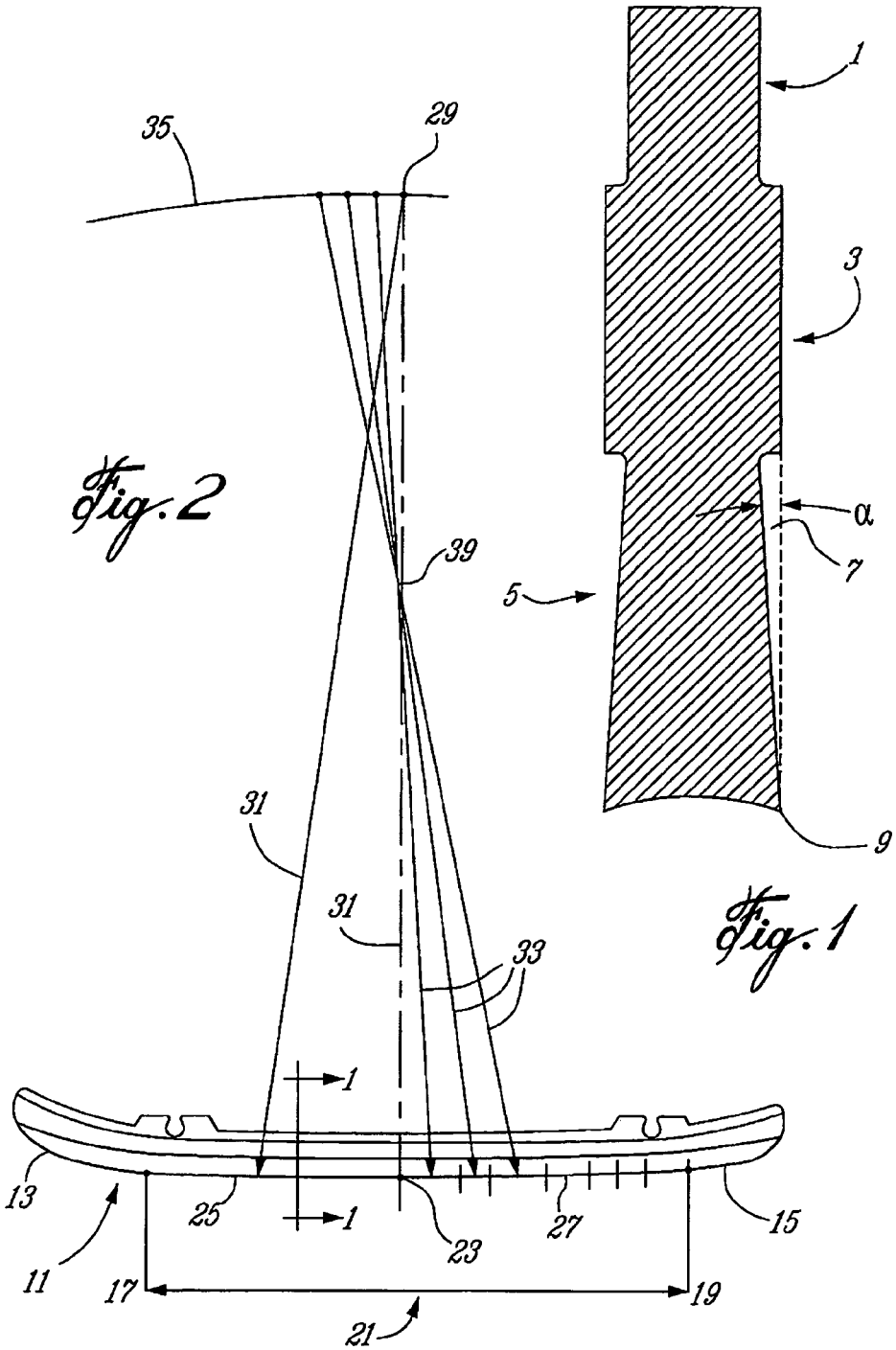
FIG. 1 is a cross-section view of a skating blade according to the invention.
FIG. 2 is a view in elevation of a skating blade according to the invention illustrating the curves provided in the rocker.
Figure 3:
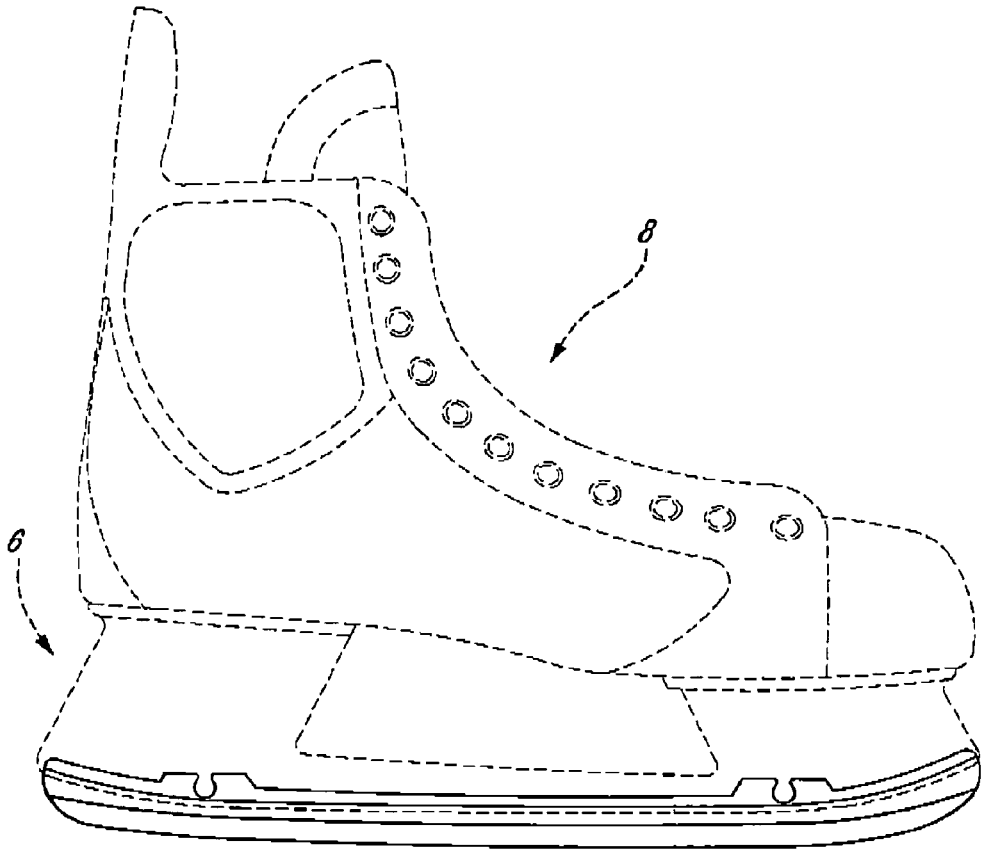
FIG. 3 is a view in elevation of a boot for the skating blade according to the invention.

With reference to the drawings, more particularly FIG. 1, it will be seen that a blade according to the invention essentially comprises three portions, namely upper portion 1, middle portion 3 and lower portion 5. The blade according to the invention is formed for a unitary plate of steel and is shaped by milling to be provided with the above mentioned portions 1, 3 and 5, as will be appreciated by one skilled in the art. To achieve this, the starting material is a steel plate 4 mm thick, whose composition is well known to those skilled in the art, that is first milled in the upper portion 1 to a thickness of 3 mm and a height of 4 mm as shown. Of course, other dimensions may be used, however it has been found that an upper portion with the above parameters is suitable for easy mounting in the blade support 6 (FIG. 3) attached to a boot 8 (FIG. 3).

Turning now to lower portion 5, the latter is also obtained by milling and this is made possible by cutting away, by milling, a triangular portion 7 starting 8 mm from the base of the blade until reaching the lower edge 9 thereof. In this manner, lower portion will be beveled to form an angle $\alpha$ between 4° and 5° with respect to the vertical. This angle $\alpha$ may of course vary depending on the choice of the skilled artisan. Lower portion 5 being beveled on both sides of the plate thereby defines middle portion 3, that is 4 mm wide and 6 mm high, as shown to provide an improved rigidity to the blade.

Again as mentioned above, in order to provide a skating blade that gives full satisfaction, it is desirable to curve the rocker in a special manner as will now be defined. With reference to FIG. 2, that shows a view in elevation of a blade according to the invention, the blade is of standard construction and differs from those of the prior art only for its cross-section that is defined with respect to FIG. 1, and the curve of the rocker 11 that will now be described. Before going into the details of the curve, it is necessary to point out that as in any standard skating blade the front and rear are both terminated by accentuated spirals, respectively front spiral 13 and rear spiral 15. Between these spirals, more specifically between points 17 and 19, rocker 11 provides a portion that is actively in contact with the ice, and that will be referred to as portion 21. Midway between points 17 and 19, there is found what will be referred to as the center point 23 of rocker.

As mentioned above, there will be formed two different curves along portion 21 of rocker 11, namely curve 25 and curve 27 that will now be described. Curve 25 extends from center 23 to point 17 of rocker 11 and curve 27 extends from center 23 to point 19 of rocker 11.

Curve 25 is shaped as an arc of a circle whose center 29 is located a predetermined distance and opposite from center 23, here between 2 and 4 meters, although other length may be used as will be appreciated by those skilled in the art. As shown in FIG. 2, center 29 is exactly vertically opposite center 23 and the distance between center point 23 and center 29 defines radius 31 of the arc of a circle that will define the shape of curve 25.

Turning now to curve 27, it will be seen that it is different from curve 25. Instead of being an arc of a circle, curve 27 is defined by pivoting a radius 33 that is identical to radius 31, in a manner that will now be described. However, before pivoting radius 33, it must be indicated that an arc of a circle 35 is first formed. This arc of a circle 35 has a radius that coincides with radius 31, but instead wherein the center is defined by point 23. To obtain curve 27 radius 33 is pivoted, about a pivoting point 39, forwardly along arc of a circle 35 and rearwardly along rocker 11, all as shown in FIG. 2, until reaching point 19 of the rocker.

The design of the tool or device used to achieve the above curves 25 and 27 is left to one skilled in the art and forms no part of the present invention.

It has been found that a skating blade whose cross-section is as defined above, possesses more rigidity enabling it to have improved performance and providing edges with much improved ice penetration with the result that trajectory changes are greatly facilitated, and better release are obtained when skating.

Furthermore, by providing the rocker with the above described curves, comfort is improved, better speed and turning facility are achieved, with less risk of injuries.

It is understood that modifications are possible within the scope of the present invention, as defined in the appended claims.

I claim:

1. An ice skate blade adapted for being mounted in a support attached to an ice skate boot, said blade comprising: a lower portion having a cross-section with a length 11, along a longitudinal axis, the cross-section having an uppermost part with a width w1, along a transversal axis perpendicular to the longitudinal axis, and a lowermost part with a width w2, along the transversal axis, wider than the width w1 of the uppermost part providing a pair of spaced-apart acute ice skating edges; a middle portion extending above the lower portion and having a cross-section defined with two longitudinal space-apart edges, the cross-section of the middle portion having a width w3, along the transversal axis, and a length 12, along the longitudinal axis, the length 11 of the lower portion being longer than the length 12 of the middle portion and the width w3 being wider than the width w1 for reinforcing the blade, the longitudinal space-apart edges of the middle portion extending substantially parallel to one another along the length 12; and an upper portion extending above the middle portion and having a cross-section with a width w4, along the transversal axis, narrower than the width w3 of the middle portion, the width w4 enabling to fix said skate blade to said support attached to said boot.

2. An ice skate blade according to claim 1, wherein said acute ice skating edges define an angle between 2 and 8° with respect to the longitudinal axis.

3. An ice skate blade according to claim 1 wherein said uppermost part of said lower portion is inwardly offset by about between 0.3 and 0.8 mm with respect to said middle portion.

4. An ice skate blade according to claim 1 wherein said uppermost part of said lower portion is offset by about 0.5 mm with respect to said middle portion.

5. An ice skate blade according to claim 1, comprising a ice contacting portion having a front portion with a front curve and a rear portion with a rear curve different from the front curve along the length of the ice contacting portion, the front and the rear portions meet at a junction point, the front curve of the front portion defined by a first arc of a circle with a center point and a radius, the rear curve of the rear portion being shaped by pivoting, about a pivoting point, the radius of the front curve forwardly from said center point along a second arc of a circle with a center corresponding to the junction point and rearwardly from the junction point along the rear portion of said ice contacting portion.

6. An ice skate blade according to claim 1, comprising a ice contacting portion having a front portion with a front curve and a rear portion with a rear curve different from the front curve.

7. An ice skate blade according to claim 1, wherein the width w3 of the middle portion is substantially uniform along the length 12.

8. An ice skate blade according to claim 1, wherein the junction of the lower and middle portions defines lower shoulders and the junction of the middle and upper portions defines upper shoulders.

9. An ice skate blade according to claim 2, wherein said angle has a value between 4 and 5°.

10. An ice skate blade according to claim 5, wherein said junction point corresponds to a middle part of said ice contacting portion.

11. An ice skate blade according to claim 10, wherein said radius have a length between 2 and 4 meters.

* * * * *